US005379902A

United States Patent [19]

Wen et al.

[11] Patent Number: 5,379,902

[45] Date of Patent: Jan. 10, 1995

[54] METHOD FOR SIMULTANEOUS USE OF A SINGLE ADDITIVE FOR COAL FLOTATION, DEWATERING, AND RECONSTITUTION

[75] Inventors: Wu-Wey Wen, Murrysville; McMahan L. Gray, Pittsburgh; Kenneth J. Champagne, Finleyville, all of Pa.

[73] Assignee: The United States of America as represented by the United States Department of Energy, Washington, D.C.

[21] Appl. No.: 149,270

[22] Filed: Nov. 9, 1993

[51] Int. Cl.[6] ..... B03D 1/02; B03D 1/006; B03B 1/04

[52] U.S. Cl. ..... 209/166; 252/61; 210/768; 210/770

[58] Field of Search ..... 209/166, 167; 252/61; 210/710, 730, 768, 770; 44/621, 626, 627

[56] References Cited

U.S. PATENT DOCUMENTS

| | | |
|---|---|---|
| 1,595,731 | 8/1926 | Quigley . |
| 1,678,379 | 7/1928 | Chapman . |
| 2,028,742 | 1/1936 | Frantz . |
| 2,112,362 | 3/1938 | Gillson . |
| 2,744,626 | 5/1956 | Reerink . |
| 3,361,259 | 1/1968 | Von Der Gathen . |
| 3,807,557 | 4/1974 | Miller . |
| 4,162,966 | 7/1979 | Finch . |
| 4,222,861 | 9/1980 | Finch . |
| 4,222,862 | 9/1980 | Finch . |
| 4,270,926 | 6/1981 | Burk . |
| 4,272,250 | 6/1981 | Burk . |
| 4,340,467 | 7/1982 | Wang . |
| 4,415,337 | 11/1983 | Kutta . |
| 4,426,282 | 1/1984 | Aursholt . |
| 4,466,887 | 8/1984 | Gross . |
| 4,476,013 | 10/1984 | McCaffrey . |
| 4,528,107 | 7/1985 | McCaffrey . |
| 4,532,032 | 7/1985 | Ng . |
| 4,632,750 | 12/1986 | McGarry . |
| 4,756,823 | 7/1988 | O'Neill . |
| 4,966,608 | 10/1990 | Pawlak . |
| 4,969,928 | 11/1990 | Wen et al. . |

FOREIGN PATENT DOCUMENTS

| | | |
|---|---|---|
| 1201223 | 2/1986 | Canada . |
| 58-103592 | 6/1983 | Japan . |
| 104569 | 12/1979 | Poland . |
| 2072700 | 3/1980 | United Kingdom . |
| 2171336 | 8/1986 | United Kingdom . |
| 369931 | 4/1973 | U.S.S.R. . |
| 556836 | 9/1977 | U.S.S.R. . |
| 657854 | 4/1979 | U.S.S.R. . |
| 833323 | 5/1981 | U.S.S.R. . |
| 1165469 | 7/1985 | U.S.S.R. . |
| 1256793 | 9/1986 | U.S.S.R. . |
| 1479111 | 5/1989 | U.S.S.R. . |

OTHER PUBLICATIONS

Lewis, Robert M. "Research Approach to Flotation of Strip Mine and Deep Mine Coals", Transactions of AIME, vol. 252, Jun. 1972 pp. 147–149.

Wen et al., "The Coal Reconstitution By An In Situ Hardening Process", The Inst. For Briquetting and Agglomeration (1989).

Wen et al., "A New Strategy For Fine Coal Dewatering And Reconstitution", Fluid/Particle Separation Journal (Dec. 1988).

Presentation: 9th Annual Coal Preparation, Utilization and Environmental Control Contractor Conference (Jul. 19–21, 1993).

Presentation: International Coal Conference: Toronto, Canada (Sep. 1993).

Pres. 5th International Conference: Processing and Utilization of High Sulfur Coals (Oct. 24–28, 1993).

Becher, P., "Emulsions: Theory and Practice", 2nd Ed. ACS Monographs No. 162, Reinhold, N.Y. 1965.

*Primary Examiner*—Thomas M. Lithgow

*Attorney, Agent, or Firm*—Hugh W. Glenn; Robert J. Fisher; William R. Moser

[57] ABSTRACT

A single dose of additive contributes to three consecutive fine coal unit operations, i.e., flotation, dewatering and reconstitution, whereby the fine coal is first combined with water in a predetermined proportion so as to formulate a slurry. The slurry is then mixed with a heavy hydrocarbon-based emulsion in a second predetermined proportion and at a first predetermined mixing speed and for a predetermined period of time. The conditioned slurry is then cleaned by a froth flotation method to form a clean coal froth and then the froth is dewatered by vacuum filtration or a centrifugation process to form reconstituted products that are dried to dust-less clumps prior to combustion.

17 Claims, 1 Drawing Sheet

METHOD FOR SIMULTANEOUS USE OF A SINGLE ADDITIVE FOR COAL FLOTATION, DEWATERING, AND RECONSTITUTION

BACKGROUND OF THE INVENTION

1. Field of the Invention

The present invention relates to a method for improving efficiencies in the cleaning processes of finely-divided carbonaceous material and specifically to a method for improving flotation, dewatering and reconstitution in fine coal processing with the addition of a single additive at the beginning of the process.

2. Background of the Invention

Demand for environmentally acceptable coal continues to increase. This results in the need for improvements in physical coal cleaning processes. Classical coal beneficiation involves separation of the combustible and mineral matter of coal by methods based on differences in density. However, mechanized coal mining techniques, combined with the need to liberate mineral matter through deeper cleaning, has lead to the industry having to deal with treating larger amounts of coal fines. To optimize such mineral matter rejection, coal is reduced to sizes smaller than 28 mesh (600 microns (μm)). This emphasis on fine coal beneficiation has lead to separation processes that depend on differences in surface properties of the particles rather than on their densities.

Most conventional fine coal cleaning processes employ water or water-based media for the removal of pyritic sulfur and ash-forming mineral matter from raw coal before sale. However, small particle size distribution of these product slurries makes subsequent dewatering of these fine coal products a difficult problem. Most techniques require application of expensive and time consuming thermal dryers. In addition, the thermally dewatered product, owing to its dusty nature and its increased reaction rate with oxygen, possesses its own set of handling, transportation and storage problems, and it often causes safety and environmental problems. Some of these problems include spontaneous combustion, explosion, wind erosion, and dust pollution.

The rejection of water from fine coal particles by conventional vacuum filtration and centrifugation processes is enhanced by the addition of surfactants and flocculants. A commercial water-based (oil-in-water) asphalt emulsion has been used for the dewatering and reconstitution of fine coal particles. (U.S. Pat. No. 4,969,928). However, these asphalt emulsions, prepared with cationic type surfactants, are not collectors for the initial coal cleaning step, which is coal flotation. Emulsified asphalt also fails to provide adequate dewatering and dust reduction when slurry temperature is low. Furthermore, asphalt is a product of the petroleum refining process, and not naturally formed, thereby leading to high costs associated with its use.

A cost effective fine coal beneficiation process is needed to separate coal fines from mineral matter, dewater the clean coal, and then reconstitute the clean coal into a low moisture and low dustiness product for utility use. The process should embody a single addition step wherein emulsions of heavy hydrocarbons are used as surface selective additives to enhance flotation, dewatering and agglomeration of fine coal products.

SUMMARY OF THE INVENTION

It is an object of the present invention to provide a simple and cost effective method for flotation, dewatering and reconstitution of coal fines which overcomes many of the disadvantages of fine coal beneficiation processes disclosed in the prior art.

It is another object of the present invention to provide for a method to more efficiently float coal fines, dewater the fines, and agglomerate the fines through the single application of an additive into the slurry. A feature of the invention is using a heavy hydrocarbon-based emulsion system. An advantage of the invention is the use of low cost heavy hydrocarbon-based emulsions compared to more conventional light oil-based, Kerosene-based, or No. 2 fuel oil-based emulsions for coal processing methods.

Yet another object of the present invention is to provide for a method to produce coal fines with less mineral matter. A feature of the invention is the use of a bitumen combined with a surfactant. An advantage of the invention is that the size and shape of the emulsion droplet can be tailored to specifically bind to clean coal but not to mineral matter surfaces, resulting in flotation of the coal and rejection of the mineral matter as tailings.

Still another object of the present invention is to provide for a method to produce fine coal products having lower moisture content. Another object of the invention is to provide for a method to moderately agglomerate, or harden, the clean fine coal. A feature of the invention is using a bitumen-based emulsion system as a bridging liquid to form agglomerates during dewatering so that the dustiness of the clean fine coal would be significantly reduced upon drying, and its handling thus improved. An advantage of the invention is reducing the necessity of using energy intensive and potentially dangerous thermal drying techniques to dewater agglomerated coal fines.

Briefly, the invention provides a method for floating, dewatering and reconstituting fine coal comprising combining the fine coal with water in a first predetermined proportion so as to formulate a slurry, mixing the slurry with a heavy hydrocarbon-based emulsion in a second predetermined proportion and at a first predetermined mixing speed and for a predetermined period of time so as to form a coal-emulsion mixture, subjecting the coal-emulsion mixture to froth flotation, thereby forming a froth containing clean coal and a tailing containing mineral matter, dewatering the froth to produce dewatered clean coal; and drying the dewatered clean coal to form a reconstituted dust-less product.

BRIEF DESCRIPTION OF THE DRAWING

The present invention together with the above and other objects and advantages may best be understood from the following detailed description of the embodiment of the invention illustrated in the drawings, wherein.

DETAILED DESCRIPTION OF THE INVENTION

Figure 1:
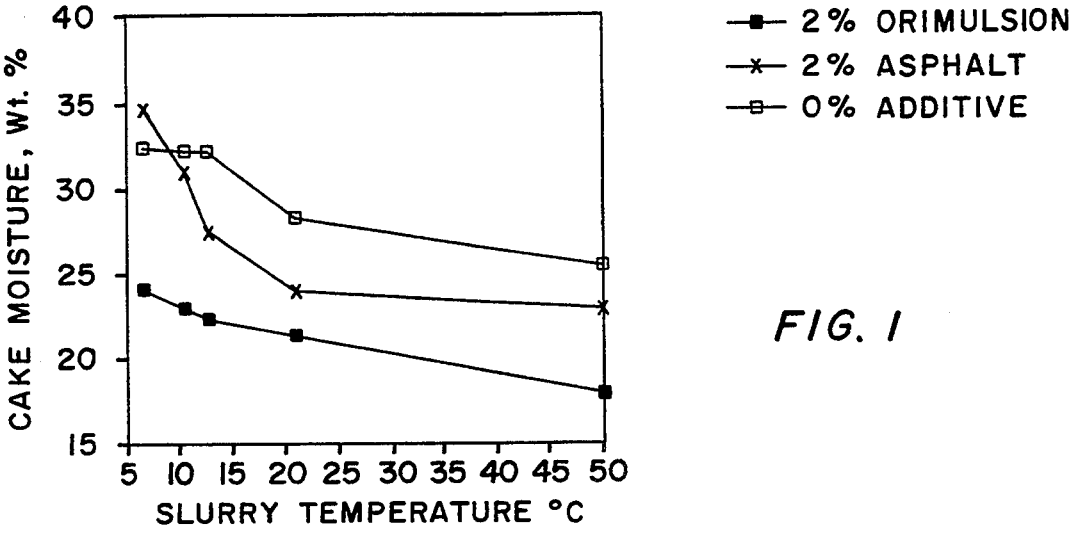
FIG. 1 is a graph depicting the effect of slurry temperature on the vacuum filter cake moisture content when two commercial heavy hydrocarbon-based emulsions, Orimulsion TM and Asphalt, are used, illustrating the present invention.

The invention teaches using a single dose of additive to facilitate three consecutive fine coal unit operations, namely flotation, dewatering, and reconstitution. The invention involves the use of a heavy hydrocarbon emulsion, such as Orimulsion TM, as a collector in a froth flotation process, as a filtration aid in a vacuum filtration dewatering process, and subsequently as an agglomerating agent in a reconstitution process consisting of binding dried agglomerated product into dust-less clumps. Kerosene, commonly used as a coal collector in the flotation step, is no longer necessary, but could be used as a supplement. Asphalt emulsion, taught in the prior art as an agglomerant and binder, can also be eliminated or reduced in amount to reduce cost.

A finely divided carbonaceous material is floated, agglomerated, dewatered, and reconstituted in a combined process by employing emulsions of heavy hydrocarbons as surface selective additives to enhance both separation and the dewatering of fine coal products. The heavy hydrocarbon emulsion droplet serves as an oily collector in froth flotation and also as a binder to form agglomerates during dewatering and reconstitution. The advantage of using the emulsified reagent is that the size and surface charge of the droplet can be tailored, via appropriate surfactant additives and emulsified reagents, to bind to clean coal but not to mineral matter surfaces. The goal is to control the emulsion droplet surface properties so that it interacts selectively with coal particles only, resulting in flotation of the coal and rejection of the mineral matter as tailings.

The invention teaches forming emulsions of heavy hydrocarbons and adding those emulsions directly into the slurry. The final product, after flotation and vacuum filtration, is a clean, dewatered cake or consolidated piece of coal which can be hardened by drying at ambient or elevated temperature. Thus, an economical process is provided herein to produce clean coal, to dewater the clean coal and to reconstitute the clean coal into a low moisture and low dustiness product for utility use.

Coal Species Detail

By applying the invented method to a myriad of different types of coal, the inventors have concluded that their additive process is applicable to a wide range of coal types, including those coals having an ash content ranging from between 0 to 30 percent and a sulfur content ranging from between 0 and 8 percent. Various coal types can be treated here, including, but not limited to, peat, lignite, subbituminous coal, bituminous coal and anthracite coal. The specific coal species to which the invented method has been applied by the inventors include those found in the Pittsburgh No. 8 seam (23 percent ash, 6.5 percent sulfur) from Belmont County, Ohio; in the Illinois No. 6 seam (14.2 percent ash, 4.9 percent sulfur) from Randolph County, Ill.; in the Lower Kittanning seam, (15.4 percent ash, 8.4 percent sulfur) from Clearfield, Pa.; and in the Upper Freeport seam (11.5 percent ash, 1.5 percent sulfur) from Indiana County, Pa. All coal samples were stage crushed to 28 mesh by 0 using a hammer mill. An additional Pittsburgh seam coal, from the U.S. Bureau of Mines experimental mine in Bruceton, Allegheny County, Pa. was ground to 74-micron (200 mesh) and used in dewatering and reconstitution studies.

Generally, particle sizes less than 1000 μm, and more typically 600 μm (28 mesh) constitute fine particles within the scope of this invented process. Such particles are combined with water in weight percents ranging from 1 percent to 50 percent to form slurries for subsequent processing. Dried coal at zero percent moisture can also be used in reconstitution processes to form pellets, briquettes and compacted products.

Emulsion Formulation Detail

Emulsions were formulated from several heavy petroleum fractions and coal derived pyrolysis-tars. Emulsification conditions were typical for oil-in-water systems, as outlined in Becher, P., *Emulsions: Theory and Practice,* 2nd Ed, ACS Monographs, No. 162, Reinhold, N.Y. 1965, and incorporated herein by reference.

Stable water-based emulsions were prepared by adding the surfactants to a heavy oil phase first and then slowly adding a water-surfactant mixture with agitation until the final emulsion was formed. (To reduce the viscosity of the heavy oils prior to mixing with surfactant, said oils can be heated to a temperature selected from a range of between approximately 50° C. and 100° C. for a predetermined period of time selected from a range of between approximately 5 minutes and 60 minutes. Surfactants are then added to the oil phase at a predetermined surfactant temperature selected from the range of between approximately 50° C. and 100° C., and at a temperature lower than the boiling temperature of the surfactant.) The heavy oil-first surfactant/water-second surfactant mixture is emulsified at a speed selected from the range of between approximately 3000 rpm, and 22,000 r.p.m., and at temperatures ranging from between approximately 40° C.–60° C. (In the laboratory, such speeds were obtained using a Waring blender.)

The aqueous coal phase is slowly added to the above emulsion mixture and the two phases are blended at a speed selected from a range of between approximately 3000 rpm and 10,000 rpm for a predetermined period of time selected from a range of between approximately 0.5 minutes and 5 minutes. The emulsion-to-coal weight percent is selected from a range of between approximately 0.1 percent and 20 percent, and preferably from a range of between approximately 1 percent and 10 percent.

The weight percents of the various constituents of the emulsion will vary, depending on coal type. Generally, the weight percent of the heavy oil phase will range from approximately 30 percent to 60 percent. The first surfactant (i.e., that used in the oil phase) will range in weight value from approximately 0.5 percent to 10 percent. The water component of the emulsion will range in weight from approximately 15 percent and 35 percent, and the second surfactant (i.e., that used in the water phase) will range in value from 0.05 percent to 2 percent. Preferable values for the oil are 40–50 percent, 1–6 percent for the first surfactant, 20–30 percent for the water component, and 0.1–1 percent for the second surfactant.

Oil Phase Detail For Emulsion Formation

An advantage of the invented coal-fine processing method is the use of heavy oil fractions, primarily as these fractions are naturally occurring and therefore less expensive than, for example, asphalt. These heavy oils are predominantly either aliphatic or aromatic chemical structures. The overall performance of the invented heavy-oil/water-based emulsions will be dependant upon their chemical composition and their interactions with coal particle surfaces.

A myriad of types of heavy oils can be utilized as the oil phase component for the instant method, including, but not limited to, aliphatic bitumens, highly aromatic coal tar, tar sand- and oil shale-derived bitumens, gilsonite and combinations thereof. (Gilsonite is an asphalt or solidified hydrocarbon found only in the United States in Utah and Colorado. It is one of the purest of natural bitumens, at 99.9 percent.) Feedstocks having carbon chain lengths of between 12 and 30 carbons are good heavy oil candidates for the process. Specific fractions that can be utilized in this method are selected from the group consisting of No. 6 Fuel Oil, petroleum crude oil, White Rock Bitumen (a Utah Tar sand), Athabasca Bitumen (a Canadian Tar sand), Orimulsion TM (a Bitumen emulsion product from Bitumens de Orinoco S.A. of Venezuela), and combinations thereof. In comparison with the aliphatic bitumens, coal tar has higher carbon and lower hydrogen weight percent values, which indicates a higher degree of aromaticity. A Canadian tar sand used by the inventors had the highest level of sulfur but the dewatering ability of this oil remained unaffected.

Surfactant Detail For Emulsion Formation

Formation of stable water-based emulsions is critical. Generally, the heavy hydrocarbon emulsion formulated in the invented method uses additive packages incorporating cationic, anionic, and nonionic surfactants to yield emulsion droplets having positive, negative and minimal surface charge, respectively.

Nonionic surfactants are less sensitive to pH change, electrolytes and water hardness and therefore preferred over ionic surfactants under many coat cleaning conditions. For more polar low rank coals, surfactants are first needed to generate a more hydrophobic surface before the non-polar reagent can function at optimal levels. Surfactants are also needed to stabilize droplet size and to assist in spreading the oils on the coal surfaces, otherwise, oil droplets in the emulsion will coalesce with each other and prevent optimum dispersion of the emulsion. An example of the desired surfactant effect is the dramatic increase in coal recovery (up to 95 percent) when kerosene, functioning as the surfactant, is added to a slurry, followed by the addition of the bitumen emulsion Orimulsion TM Data showing the optimum dispersion of the emulsion corresponding to a drop diameter of 5 μm for kerosene illustrates the mechanism of the instant invention wherein the dispersion of certain size oil droplets is critical for maximum coal recovery and optimum selectivity.

A key consideration in surfactant selection is the hydrophile-lyophile balance (HLB number). In many cases, it is advantageous to mix surfactants with different HLBs to obtain optimum stability in the resulting emulsion. Surfactants with HLB values greater than 12 produced the most stable water-based emulsions because of their strong hydrophilic characteristics. Basic chemical structure types employed as surfactants include, but are not limited to, linear polyoxyethylene alkoxides, nonylphenol alkoxides, and hydrofluorocarbon alkoxides. Anionic surfactants are of the fatty acid genre, whereas cationic emulsifiers are fatty amines, such as the diamines, imidazolines, and the amidoamines. Such surfactants can be selected from the group consisting of nonionic octylphenoxy-polyethanol, nonionic nonylphenol ethoxylated polyethylene glycol, cationic-Tallow amine surfactants, and combinations thereof.

A myriad of commercial surfactants are available to facilitate the formulation of the emulsions discussed herein. They include the following:

The IGEPAL® CA product line produced by Rhone Poulence, Cranbury, N.J., including #520, 620, 630, 520, 610, 630 and 730. These surfactants are generally of the octyl-, or nonylphenoxypoly(ethyleneoxy) ethanol variety.

The VARONIC® product line, available from Sherex in Dublin, Ohio. VARONIC® surfactants, such as #K210-SF, #K215-SF, #T210-SF, and #T215-SF (i.e., the cationic fatty amines) includes the Coconut Amine Ethoxylates and Tallow Amine Ethoxylates.

HYPERMER® LP8 FROM ICI Specialty Chemicals, Wilmington, Del., PLURAFAC® A-38, a linear alcohol alkoxylate, from BASF, Parsippany, N.J.

TRITON® X-100, an octylphenoxypoly(ethyleneoxy) ethanol, from Union Carbide, Danbury, Conn.

DOWFAX® 8390, an anionic alkyl biphenyloxy sulfonate, available from Dow Chemical Co., in Midland, Mich.

Ratios of these surfactants to the oil phase ranges from approximately 0.1 percent to 10 percent by weight, and preferably 1.0 percent by weight.

Anionic surfactants, such as ZONYL®, (a fluorosurfactant) available from Dupont, in Wilmington, Del., or TWEEN®, or SPAN®, both available from ICI Specialty Chemicals also in Wilmington, could be used for the aqueous phase surfactant, designated herein as the second surfactant. Generally, any basic straight chain surfactants are good candidates as the second surfactant. The desired effect with the second surfactant is a lowering of the surface tension, i.e., an increase in detergency, so as to minimize droplet size.

The size of droplets and their surface charges for typical emulsions of White Rock, Utah tar-sand bitumen are described in table 1, below:

TABLE 1

| Oil Phase (Bitumen) | Surfactant Type | Droplet Size (Mean Vol. Dia.) | Zeta Potential |
|---|---|---|---|
| White Rock | nonionic | 8 microns | +6 mV |
| White Rock | cationic | 6 microns | +61 mV |
| White Rock | anionic | 10 microns | −27 mV |

These emulsions proved successful as collectors in froth flotation and as dewatering aids in vacuum filtration of fine coal slurries. Such additives could therefore promote flotation, aid in dewatering of the product froth, and suppress dust in the dry product.

Flotation Process Detail

The flotation of minus 600 μm particle coal was conducted using the invented water-based coal emulsion system and the results were compared with those obtained using methyl isobutyl carbinol (MIBC)/kerosene. In one experimental work-up, a 200 gram sample of coal was placed into a WEMCO flotation cell and conditioned in 3 liters of water for 10 minutes. The pH of the coal slurry was adjusted, by the addition of one molar sodium hydroxide or hydrochloric acid solutions, to between approximately pH 3 and pH 11.

Following the pH adjustment, the slurry was conditioned for two minutes with MIBC and kerosene or with the water-based emulsion. After conditioning, the air was turned on and the froth was collected for two minutes, dried and weighed. The clean product and tails were analyzed for sulfur and ash to determine the flotation efficiency.

As can be determined from the data presented in Table 2, below, the heavy-oil based emulsion system provides superior results, particularly in low pH conditions. The system was implemented on Lower Kittanning seam coal which is difficult to float. During the flotation tests, the dosage of the MIBC/kerosene liquor was maintained at 1 lb. per ton while the coal tar dosage was 5.8 lb/ton.

TABLE 2

Flotation Results of coal using Coal Tar-, versus MIBC/Kerosene emulsion systems.

| Test # | Reagents | pH | % Yield | % Sulfur | % Ash |
|---|---|---|---|---|---|
| 1 | MIBC/Kerosene | 4 | 54.4 | 5.2 | 11.0 |
| 2 | " | 7 | 75.1 | 5.3 | 10.9 |
| 3 | " | 10 | 75.7 | 4.9 | 11.1 |
| 4 | Coal Tar | 4 | 83.1 | 5.3 | 11.5 |
| 5 | " | 7 | 62.5 | 4.0 | 8.4 |
| 6 | " | 10 | 66.7 | 3.6 | 8.4 |

At pH of 4, the coal tar emulsion resulted in a significantly higher clean coal yield than that achieved by the MIBC/kerosene collection system, per the results depicted in tests 1 and 4. With the presence of the coal tar and surfactants, there is an increase in particle hydrophobicity as well as a reduction of the surface tension resulting in more froth product. Upon increasing the pH of the coal slurry, the good rejection of the sulfur and ash was achieved using the coal tar emulsion as the frother and collector, as depicted in tests 5 and 6.

Flotation was also facilitated using Orimulsion TM. As is depicted in Table 3, flotation with 0.25 kg/t (0.5 lb/ton) MIBC produced only 50.3 percent froth yield (clean coal) containing 7.3 percent ash and 5.3 percent total sulfur. The addition of kerosene at 1.75 kg/t (3.5 lb/ton) increased the froth yield to 72 percent containing 9.9 percent ash and 5.7 percent total sulfur. Further addition of kerosene beyond 1.75 kg/t (3.5 lb/ton) did not increase the yield. Flotation tests with Orimulsion TM at dosages of 20 kg/t (40 lb/ton) achieved comparable yields obtained with kerosene. The relatively larger amounts of Orimulsion TM present is used for subsequent dewatering and reconstitution steps. As more Orimulsion TM was used, the froth yield increased continuously. When 20 kg/t (40 lb/ton, about 2 percent) of Orimulsion TM was used, the froth yield was 72 percent and selectively was comparable with that observed at a kerosene dosage of 1.75 kg/t (3.5 lb/ton).

Test results revealed that flotation tests with Orimulsion TM required a much larger dosage than flotation tests with kerosene to achieve comparable yield. However, this higher dosage of approximately 20 kg/ton (40 lb/ton) does not pose serious economic disadvantage since Orimulsion TM costs about the same as coal on a heating basis; furthermore, this amount is needed for the subsequent dewatering and reconstitution steps.

TABLE 3

Flotation Results of Pittsburgh No. 8 seam coal (23.0% ash and 6.5% sulfur) at 590 microns (28 mesh) top size with 0.25 kg/t (0.5 lb/ton) MIBC.

| | Yield % | | Ash % | | Sulfur % | | Combust. |
|---|---|---|---|---|---|---|---|
| Rgnt | Froth | Tail | Froth | Tail | Froth | Tail | Yield % |
| None | 50.3 | 49.7 | 7.3 | 39.9 | 5.3 | 7.1 | 61.0 |
| Kerosene | | | | | | | |
| (1.75 kg/t) | 72.0 | 28.0 | 9.9 | 58.5 | 5.7 | 7.7 | 84.8 |
| (3.5 kg/t) | 74.3 | 25.7 | 9.9 | 61.8 | 5.7 | 8.2 | 87.2 |
| Orimulsion TM | | | | | | | |
| (2.5 kg/t) | 61.1 | 38.9 | 7.8 | 47.4 | 5.3 | 7.8 | 73.4 |
| (5 kg/t) | 62.1 | 37.9 | 8.6 | 46.5 | 5.5 | 7.7 | 73.7 |
| (10 kg/t) | 67.0 | 33.1 | 9.3 | 49.5 | 5.7 | 8.1 | 78.4 |
| (20 kg/t) | 72.0 | 28.0 | 10.4 | 52.9 | 5.7 | 7.7 | 83.0 |

Flotation results from Upper Freeport seam coal, presented in Table 4, evidenced a high natural hydrophobicity, producing 65.7 percent froth yield with 0.25 kg/t of MIBC only.

TABLE 4

Flotation Results of Upper Freeport Seam Coal[1] using Kerosene versus Orimulsion TM

| | Wght % Froth | Ash % Froth | Sulfur % Froth | Coal Recov. |
|---|---|---|---|---|
| No Collector | 65.7 | 6.98 | 1.06 | 69.12 |
| Kerosene (1 lb/t) | 87.03 | 9.16 | 1.22 | 89.30 |
| Orimulsion TM | | | | |
| (20 lb/ton) | 79.03 | 8.14 | 1.23 | 82.05 |
| (40 lb/ton) | 81.12 | 8.94 | 1.29 | 83.51 |

[1]28 mesh × 0. Ash content = 11.5%; Sulfur content = 1.5%.

The ash and sulfur content of the clean coal was reduced to 7.0 percent and 1.1 percent, respectively from 11.5 percent ash and 1.5 percent sulfur in the feed. The addition of 0.5 kg/t of kerosene resulted in the froth yield increasing to 87 percent, while the addition of 10 kg/ton (20 lb/ton) of Orimulsion TM increased froth yield to 79 percent.

As depicted in Table 5, Illinois No. 6 samples indicated a low natural hydrophobicity, with 7.9 percent froth yield using 0.25 kg/t (0.5 lb/ton) MIBC only. Yields with kerosene (0.5 kg/t) increased to 63.9 percent and further increased to 84.9 percent when kerosene concentrations doubled. A 65.0 percent recovery was obtained with Orimulsion TM (20 kg/t).

TABLE 5

Flotation Results of Illinois No. 6 Coal[1] using kerosene versus Orimulsion TM.

| | Weight % Froth | Ash % Froth | Sulfur % Froth | Coal Recov. |
|---|---|---|---|---|
| No Collector | 7.91 | 9.61 | 3.45 | 8.07 |
| kerosene | | | | |
| 1 lb/ton | 63.62 | 8.26 | 3.87 | 66.24 |
| 2 lb/ton | 84.93 | 8.70 | 4.00 | 87.71 |
| Orimulsion TM | | | | |
| 20 lb/ton | 36.29 | 8.12 | 3.83 | 37.64 |
| 40 lb/ton | 64.99 | 8.67 | 4.15 | 66.93 |

[1]28 mesh × 0; Ash content = 14.2%, Sulfur content = 4.9%.

Dewatering Detail

After treatment with heavy oil emulsion, the coal fines are typically dewatered by vacuum filtration. Dewatering can also be facilitated through centrifugation.

Dewatering agents function by increasing the effective particle size of the slurry through agglomeration, which enhances the stability and porosity of the filter cake, and by influencing the interaction between water and particle surfaces.

The invented emulsion systems were found to be effective in dewatering extremely fine coal particles by vacuum filtration, wherein pressures of between approximately 15 inches of mercury and 30 inches of mercury, and preferably 22 inches of mercury are applied for a time period selected from between approximately 1 minute and 10 minutes.

In an experimental workup, a 100-gram sample of coal was added to 400 grams of water and agitated with a mechanical mixer at 600 rpm for 10 minutes to form the initial slurry. The water-based emulsion was added and the treated slurry was agitated in a Waring blender at 7,200 rpm for 15 seconds. Mixing speeds can range from 300 rpm to 10,000 rpm. Moisture content of the filtered cake was determined by the weight loss during a four hour drying period at 105° C.

Dewatering of the 600 μm Pittsburgh seam coal sample without emulsion treatment resulted in a final cake moisture of 23 percent. When the slurries were treated with 0.4 grams of the water-based emulsions, the cake moistures were reduced to the range of 11–14 percent. These results are shown in Table 6, below.

The most effective emulsion for the dewatering of the minus 600 μm slurry was the coal tar, which suggests that at this concentration, the aromatic oils are the most effective. It is assumed that this aromatic-oil, water-based emulsion has the ability to effectively disperse onto the coal particle surface, improving the efficiency of dewatering and the formation of stable agglomerates.

TABLE 6

Dewatering of Minus 600 micron Pittsburgh Coal at One Weight Percent Water-Based Emulsion[1].

| Emulsion | % Cake Moisture |
|---|---|
| None | 23.0 |
| Utah Tar Sand | 14.0 |
| Canadian Tar Sand | 13.8 |
| Coal Tar | 11.3 |

[1]The 1% emulsion addition is equivalent to 0.6% addition of heavy oil.

The temperature dependency of the viscosities of asphalt and bitumen are different and therefore affect the in situ cake hardening process differently. FIG. 1 shows the effect of slurry temperature on vacuum filter cake moisture content for Pittsburgh seam Bruceton Mine coal at 74 μm top size with and without using Orimulsion TM and asphalt. Generally, the moisture content of Orimulsion TM treated cakes were about 9 percent lower than cakes without Orimulsion TM treatment, and the lower slurry temperature produced higher cake moisture. For example, the cake moisture at 7° C., 21° C., and 50° C. were 24 percent, 21.4 percent and 17.9 percent, respectively, with 2 percent Orimulsion TM, and 32.2 percent, 28.2 percent and 25.5 percent, respectively, without Orimulsion TM. For 2 percent asphalt emulsion treated cakes, moisture contents were about 4 percent lower than cakes without asphalt emulsion treatment between 13° C. to 50° C. When the slurry temperatures were lower than 11° C., the moisture content of asphalt treated cake was greater than the untreated cake and it increased to 34.5 percent at 7° C. This indicates that the lower slurry operating temperature in the winter season would not affect the cake moisture with Orimulsion TM as much as it would with asphalt emulsion.

Dust Reduction Efficiency Detail

To evaluate the product dust reduction efficiency (E) due to the addition of a binder, the inventors developed a 5 minute Ro-Tap dry screening analysis method to experimentally measure the dust index (I). A dust reduction efficiency is therefore calculated and based on the following equation.

$$E = \frac{lo - li}{lo} \times 100$$

where E is the percent efficiency of dry cake dust reduction, lo is the dust index of coal without binder (cumulative weight percent of feed coal finer than 100 μm after wet screening), and li is the dust index of cake with binder (cumulative weight percent of dry cake finer than 100 μm after Ro-Tapping for 5 minutes).

Figure 2:
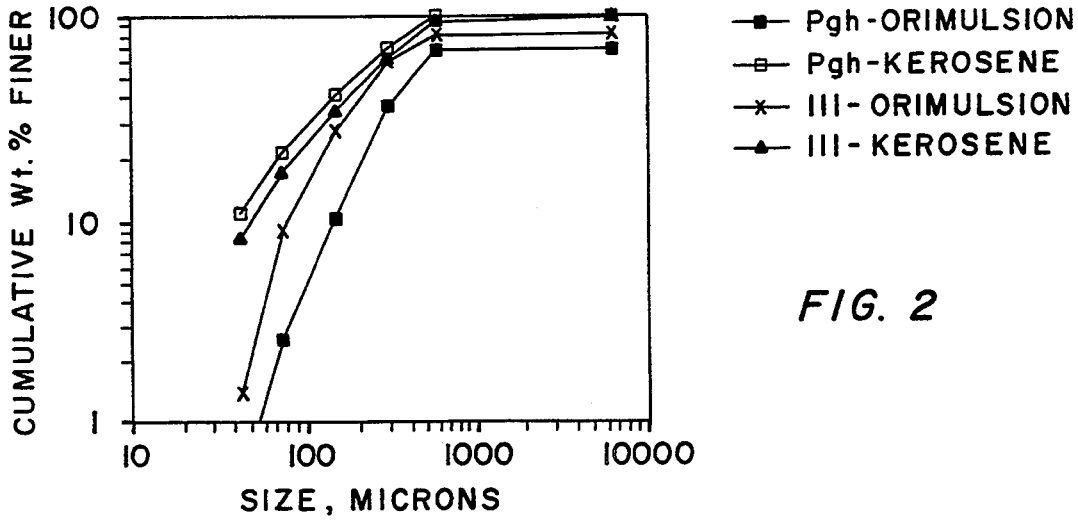
FIG. 2 is a graph depicting particle size distribution of filter cake when various flotation collectors are employed, illustrating the present invention.

The flotation concentrates generated with Orimulsion TM and kerosene were vacuum filtered, thermally dried, and then Ro-tapped for 5 minutes to determine their dust index and, therefore, the dust reduction efficiency. As depicted in FIG. 2, the resulting size distributions of filter cakes were coarser for the Orimulsion cakes for both the Pittsburgh No. 8 seam coal and for Illinois No. 6 seam coal. Specifically, for the Pittsburgh coal, the dust reduction efficiency was 83 percent for Orimulsion TM compared to 3 percent for kerosene; i.e., the weight percent of the −100 μm fraction (measure of dustiness) was only about 5 percent for Orimulsion compared to 28 percent for kerosene. For Illinois No. 6 seam coal, the dust reduction efficiency was 46 percent for Orimulsion TM, compared to 18 percent for kerosene; i.e., the filter cake is also stronger for Orimulsion® (15 percent versus 25 percent). These results indicate that Orimulsion® provides better dust reduction than kerosene.

Figure 3:
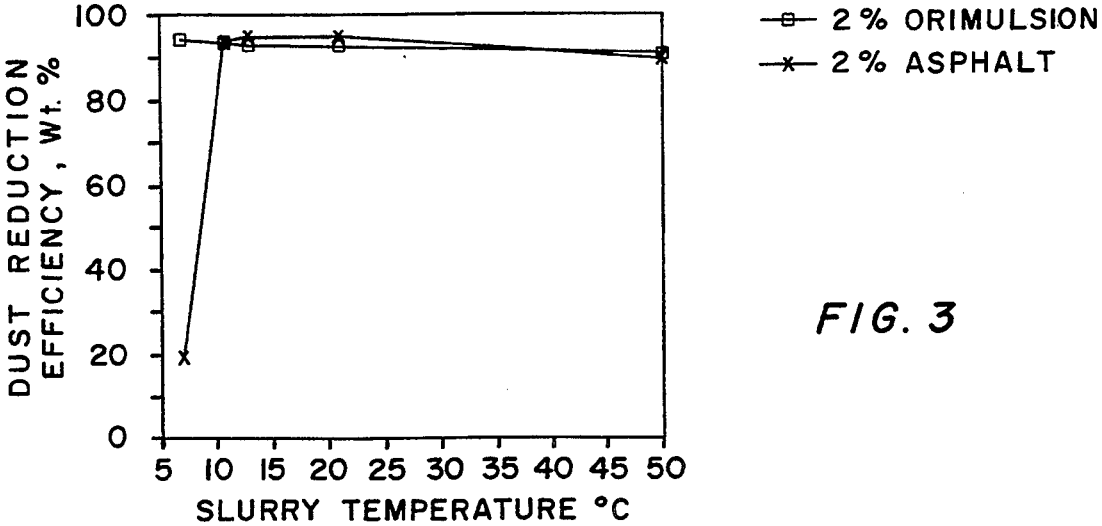
FIG. 3 is a graph depicting the effect of slurry temperature on cake dust reduction efficiency when Orimulsion TM and Asphalt is used, thereby illustrating the invention.

FIG. 3 shows the dust reduction efficiency of dewatered cakes at different slurry temperatures with both Orimulsion TM and asphalt emulsion. The data indicated that Orimulsion TM and asphalt emulsion provided similar dust reduction efficiencies of 94 percent and 91 percent at slurry temperatures between 11° C., and 50° C., respectively, but the Orimulsion TM continued to provide a high dust reduction efficiency of 94 percent at 7° C., compared to a 19 percent dust reduction efficiency of asphalt emulsion. This poor result on dust reduction between 11° C. and 7° C. for asphalt emulsion was consistent with dewatering results.

While the invention has been described with reference to details of the illustrated embodiment, these details are not intended to limit the scope of the invention as defined in the appended claims.

The embodiment of the invention in which an exclusive property or privilege is claimed is defined as follows:

1. A method for floating, dewatering and reconstituting fine coal comprising:

a) combining the fine coal with water in a first predetermined proportion so as to formulate a slurry;

b) mixing the aqueous slurry with a single addition of heavy oil phase emulsion in a second predetermined proportion and at a first predetermined mixing speed and for a predetermined period of time so as to form a coal-emulsion mixture, wherein said heavy oil emulsion is formed by mixing a first surfactant with a heavy oil and then mixing into said heavy oil-first surfactant mixture a water-second surfactant mixture, wherein said heavy oil is selected from the group consisting of aliphatic bitumen, highly aromatic coal tars, tar sand-derived bitumen, oil shale-derived bitumen, gilsonite, and combinations thereof, said first surfactant is selected from the group consisting of linear polyoxyethylene alkoxides, nonylphenol alkoxides, hydroflurorcarbon alkoxides, anionic fatty acid surfactants, cationic fatty amine emulsifiers and combinations thereof, said second surfactants is selected from the group consisting of fluorosurfactants, straight chain surfactants and combinations thereof, wherein said weight ratio of the constituents of the heavy oil emulsion is 30–60 percent heavy oil, 0.5–10 percent first surfactant, 15–35 percent water and 0.01–2 percent second surfactant;

c) subjecting the coal-emulsion mixture to forth flotation, thereby forming floating clean coal fraction in the form of a froth and a tailing containing mineral matter;

d) dewatering the froth to produce dewatered clean, agglomerated coal; and e) drying the dewatered clean coal to form a reconstituted dust-less product.

2. The method as recited in claim 1 wherein the fine coal has particle diameter sizes no greater than 1000 microns.

3. The method as recited in claim 1 wherein the predetermined proportion of fine coal to water is a percent weight ratio selected from the range of between approximately 1 percent to 100 percent.

4. The method as recited in claim 1 wherein the predetermined proportion of fine coal to water is a percent weight ratio selected from the range of between approximately 1 percent and 50 percent.

5. A method for floating, dewatering and reconstituting fine coal comprising:

mixing coal fines having particle diameters less than 600 microns with water in a 1:4 weight ratio so as to form a slurry;

combining a single addition of bitumen emulsion, wherein said bitumen emulsion is formed by mixing a first surfactant with a bitumen and then mixing into said bitumen-first surfactant mixture a water-second surfactant mixture, wherein said first surfactant is selected from the group consisting of linear polyoxyethylene alkoxides, nonylphenol alkoxides, hydroflurorcarbon alkoxides, anionic fatty acid surfactants, cationic fatty amine emulsifiers and combinations thereof, said second surfactant is selected from the group consisting of fluorosurfactants, straight chain surfactants and combinations thereof, wherein said weight ratio of the constituents of the bitumen emulsion is 30–60 percent bitumen, 0.5–10 percent first surfactant, 15–35 percent water and 0.01–2 percent second surfactant with the slurry;

subjecting the slurry containing said coal fines and bitumen emulsion to froth flotation, thereby forming a floating clean coal fraction in the form of a froth; and filtering and drying the froth to form a reconstituted product.

6. The method as recited in claim 1 wherein the heavy oil is selected from the group consisting of aliphatic bitumen, tar sand-derived bitumen, oil shale-derived bitumen, and combinations thereof.

7. The method as recited in claim 5 wherein the froth is filtered and dried by vacuum at a back pressure of 22 inches of Hg.

8. The method as recited in claim 5 wherein the step of combining the slurry with a bitumen emulsion further comprises adding a frothing agent to the combination before floatation.

9. The method as recited in claim 1 wherein the heavy oil is an aliphatic or an aromatic material having a carbon chain length selected from a range of between approximately 12 and 30.

10. The method as recited in claim 1 wherein the second predetermined proportion is selected from a range of between approximately 0.1 percent and 20 percent, the first predetermined mixing speed is selected from a range of between approximately 3,000 rpm and 10,000 rpm, and the first predetermined period of time is selected from a range of between approximately 1 minute and 30 minutes.

11. The method as recited in claim 1 wherein the heavy-oil emulsion is a bitumen emulsion.

12. The method as recited in claim 1 wherein the step of dewatering the froth employs vacuum filtration.

13. The method as recited in claim 12 wherein the froth is vacuum filtered at a back pressure selected from a range of between approximately 15 inches of Hg and 30 inches of Hg.

14. The method as recited in claim 1 wherein the step of dewatering the froth employs a centrifuge process.

15. The method as recited in claim 1 wherein the dewatered product is dried by subjecting the dewatered product to a temperature selected from a range of between approximately 20° C. and 200° C. for period of time selected from a range of approximately 5 minutes and 5 days.

16. The method as recited in claim 1 wherein the first surfactant is combined with the heavy oil in a weight percent ratio selected from a range of between approximately 0.1 percent and 10 percent.

17. The method as recited in claim 8 wherein the frothing agent is methyl isobutyl carbinol.

* * * * *